US006547515B2

(12) United States Patent
Ross

(10) Patent No.: US 6,547,515 B2
(45) Date of Patent: Apr. 15, 2003

(54) FUEL PUMP WITH VAPOR VENT

(75) Inventor: Joseph M. Ross, Millington, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/757,200

(22) Filed: Jan. 9, 2001

(65) Prior Publication Data

US 2002/0090292 A1 Jul. 11, 2002

(51) Int. Cl.[7] ..... F04D 5/00
(52) U.S. Cl. ..... 415/55.1
(58) Field of Search ..... 415/55.1, 55.2, 415/55.3, 55.4, 55.5, 55.6

(56) References Cited

U.S. PATENT DOCUMENTS 4,591,311 A 5/1986 Matsuda et al.
4,793,766 A * 12/1988 Kumata ..... 415/169.1
5,160,249 A * 11/1992 Iwai et al. ..... 415/169.1
5,192,184 A * 3/1993 Nobuo et al. ..... 415/169.1
5,221,178 A * 6/1993 Yoshioka et al. ..... 415/169.1
5,257,916 A 11/1993 Tuckey
5,338,151 A * 8/1994 Kemmner et al. ..... 415/55.1
5,413,457 A * 5/1995 Tuckey ..... 415/169.1
5,680,700 A 10/1997 Tuckey
6,010,301 A * 1/2000 Oi et al. ..... 415/169.1
6,309,173 B1 * 10/2001 Marx ..... 415/169.1

* cited by examiner

*Primary Examiner*—Edward K. Look
*Assistant Examiner*—Igor Kershteyn
(74) *Attorney, Agent, or Firm*—Reising, Ethington, Barnes, Kisselle, Learman & McCulloch, P.C.

(57) ABSTRACT

A regenerative type electric motor fuel pump has a vapor vent passage disposed outside of a fuel pumping channel and communicating the fuel pumping channel with the exterior of the fuel pump to vent fuel vapor from the fuel pumping channel. The vapor vent passage extends through one of a pair of end plates between which a pump impeller is received for rotation. Preferably, the vapor vent passage communicates with the fuel-pumping channel through a connecting slot in the end plate.

22 Claims, 2 Drawing Sheets

FUEL PUMP WITH VAPOR VENT

FIELD OF THE INVENTION

This invention relates generally to electric motor fuel pumps and more particularly to a regenerative type fuel pump having a vapor vent.

BACKGROUND OF THE INVENTION

Electric motor regenerative type fuel pumps have been employed in automotive engine fuel delivery systems. Fuel pumps of this type typically include a housing adapted to be submerged in a fuel supply tank with an inlet for drawing liquid fuel from the surrounding tank and an outlet for delivering fuel under pressure to the engine. The electric motor includes a rotor mounted for rotation within the housing and coupled to an impeller of the fuel pump for co-rotation therewith. The impeller typically has a circumferentially array of vanes about the periphery of the impeller with pockets defined, between adjacent vanes. An arcuate pumping channel, with an inlet and an outlet port at opposed ends, is communicated with the impeller periphery for developing fuel pressure through a vortex-like action on the liquid fuel in the pockets and in the surrounding channel. One example of a fuel pump of this type is disclosed in U.S. Pat. No. 5,257,916.

Agitation of the fuel, hot fuel and the relatively low pressure in a low pressure portion of the fuel pumping channel exacerbate the generation of fuel vapor in the liquid fuel within the fuel pump and fuel tank. Undesirably, the fuel vapor reduces the volume of liquid fuel pumped by the fuel pump, can cause vapor lock and stalling of the engine, and causes cavitation and increased noise in operation of the fuel pump. Accordingly, it is desirable to limit the generation of fuel vapor in the liquid fuel pumped by the fuel pump, and to vent fuel vapor from the fuel pump.

U.S. Pat. No. 5,680,700 discloses a regenerative fuel pump having an impeller with a plurality of vapor vent passages formed through the impeller radially inboard of the pockets formed between adjacent vanes of the impeller. Each vapor vent passage directly communicates with a separate pocket and when the impeller rotates the vent passages serially communicate with a vapor vent port through an end plate of the fuel pump to facilitate the discharge or venting of fuel vapor from the fuel-pumping channel.

U.S. Pat. No. 4,591,311 discloses a fuel pump having a vapor discharge port disposed within an enlarged low-pressure portion of its fuel pumping channel. The vapor discharge port is located entirely within the fuel-pumping channel and is relatively small to minimize liquid fuel loss and pressure loss in the pumping channel. Undesirably, the small vapor discharge port disposed directly within the fuel pumping channel is not effective to evacuate all fuel vapor from the fuel pumping channel and a percentage of the fuel vapor flows downstream into the higher pressure portion of the fuel pumping channel reducing the fuel pump efficiency, capacity and performance.

SUMMARY OF THE INVENTION

An electric motor regenerative type fuel pump has a vapor vent passage disposed outside of a fuel pumping channel and communicating the fuel pumping channel with the exterior of the fuel pump to vent fuel vapor from the fuel pumping channel. The vapor vent passage extends through one of a pair of end plates between which the impeller is received for rotation. Preferably, the vapor vent passage communicates with the fuel-pumping channel through a connecting slot.

Desirably, the fuel pumping channel has an enlarged cross-section low pressure portion adjacent to its inlet and leading to a high pressure portion of reduced cross-section which terminates at an outlet of the fuel pumping channel from which fuel is discharged under pressure. In the preferred embodiment, the vapor vent passage opens into the fuel pumping channel at the downstream end of the low pressure portion, immediately upstream of the high pressure portion. The vent passage is radially inward of and opens into the radially inner edge of the fuel pumping channel because the greatest concentration of fuel vapor is at the radially inner portion of the fuel pumping channel due to the centripetal force on the fluid in the fuel pumping channel. In another embodiment, the vapor vent passage opens into the fuel pumping channel at the upstream end of the high pressure portion, downstream of the low pressure portion of the fuel pumping channel. In yet another embodiment a transition in the fuel-pumping channel defines a vapor diverter which directs fuel vapor to the vapor vent passage to improve the venting of vapor from the liquid fuel in the fuel pump. In each embodiment, the vapor vent passage preferably extends through a pump plate spaced from a groove in the pump plate which defines in part the fuel-pumping channel. A connecting slot preferably communicates the fuel-pumping channel with the vapor vent passage.

Objects, features and advantages of this invention include providing an electric motor regenerative fuel pump which has improved venting of fuel vapor therefrom, utilizes a vapor vent passage disposed outside of a fuel pumping channel, reduces fuel vapor pumped and discharged from the fuel pump outlet, reduces cavitation and noise of the fuel pump in use, enables the fuel pump to be operated at low speed, enables use of electronic control of the speed of the fuel pump motor, improves efficiency of the fuel pump, improves hot fuel handling of the fuel pump, is of relatively simple design and economical manufacture and assembly, and in service has a long useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
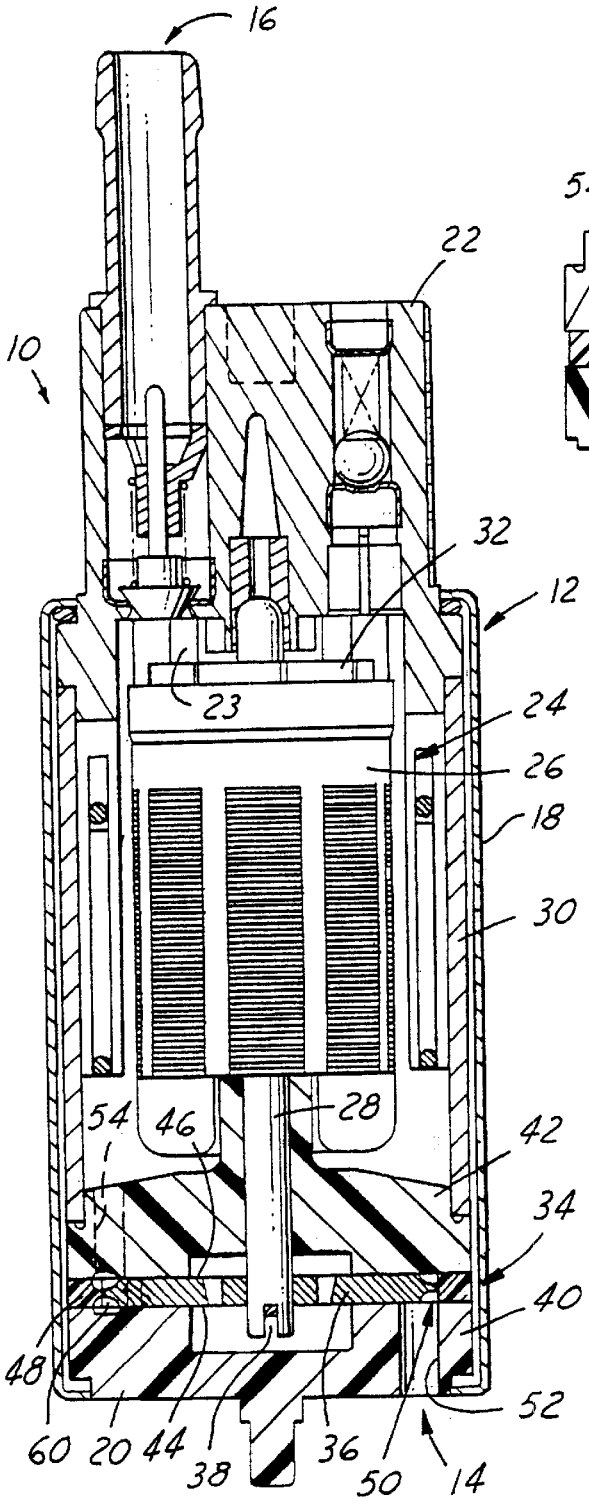
FIG. 1 is a cross-sectional view of an electric motor fuel pump embodying the present invention.

Referring in more detail to the drawings, FIG. 1 illustrates an electric motor fuel pump 10 having a housing 12 with an inlet 14 through which fuel is drawn into the fuel pump 10 and an outlet 16 from which fuel is discharged under pressure for delivery to an engine. The housing 12 has a cylindrical shell 18 which joins spaced apart inlet and outlet end caps 20, 22. An electric motor 24 has a rotor 26 journalled by a shaft 28 for rotation within the housing 12, and a surrounding permanent magnet stator 30. Brushes 23 are disposed within the outlet end cap 22 and are electrically connected to terminals positioned on the end cap 22. The brushes are yieldably urged into electrical sliding contact with a commutator plate 32 carried by the rotor 26 and shaft 28 in the housing 12. The rotor 26 is coupled to a fuel pumping mechanism 34 for drawing fuel through the inlet 14 and discharging it under pressure through the outlet 16. To the extent thus far described, the fuel pump 10 may be constructed as disclosed in U.S. Pat. No. 5,257,916, the disclosure of which is incorporated herein by reference in its entirety.

Figure 2:
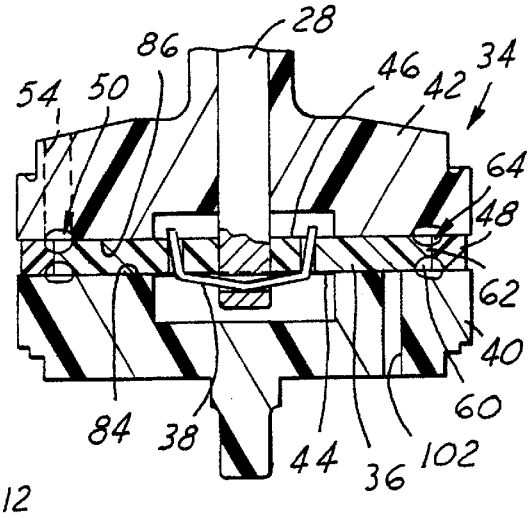
FIG. 2 is a fragmentary sectional view of a fuel pumping assembly of the fuel pump of FIG. 1 illustrating a vapor vent passage through an end cap of the assembly.

As shown in FIGS. 1 and 2, the fuel pumping mechanism 34 includes an impeller 36 coupled to the shaft 28 by a wire clip 38 or other mechanism for co-rotation with the shaft. A pair of pump housing plates 40, 42 are disposed on opposed axial faces 44, 46, respectively, of the impeller 36 with the first pump plate 40 provided by the inlet end cap 20. A split ring 48 is sandwiched between the pump plates 40, 42 surrounding the periphery of the impeller 36. The pump plates 40, 42 and ring 48 form an arcuate pumping channel 50 extending around the periphery of the impeller 36 from an inlet port 52 in the first pump plate 40 to an outlet port 54 in the second pump plate 42. The fuel pumping channel 50 spans an arc of approximately 300° to 350° with a stripper region 56 disposed outside of the fuel pumping channel 50 and between the inlet 52 and outlet port 54. An inlet section of the fuel-pumping channel preferably spans an arc of between 60° and 180° and preferably between 90° and 110°.

The impeller 36 has a circumferential array of radially and axially extending vanes 60 and a centered radially extending and circumferentially continuous rib 62. The rib 62 is preferably centered between opposed axial faces 44, 46 of the impeller 36 and cooperates with the vanes 60 to form a circumferential array of equally spaced axially facing identical pockets 64 in opposed axial faces of the impeller 36. In the preferred embodiment of the invention, the impeller vanes 60 comprise so-called closed vanes in which the bottom surface of the each vane pocket 64 formed in one axial face 44 of the impeller 36 does not intersect the bottom surface of the axially adjacent pocket 64 in the opposing impeller face 46. However, so-called open vane constructions of the type disclosed in U.S. Pat. No. 5,257,916 may also be employed. The pockets 64 on the impeller side faces 44, 46 are aligned with each other as shown, however, staggered pockets may also be employed.

Figure 3:
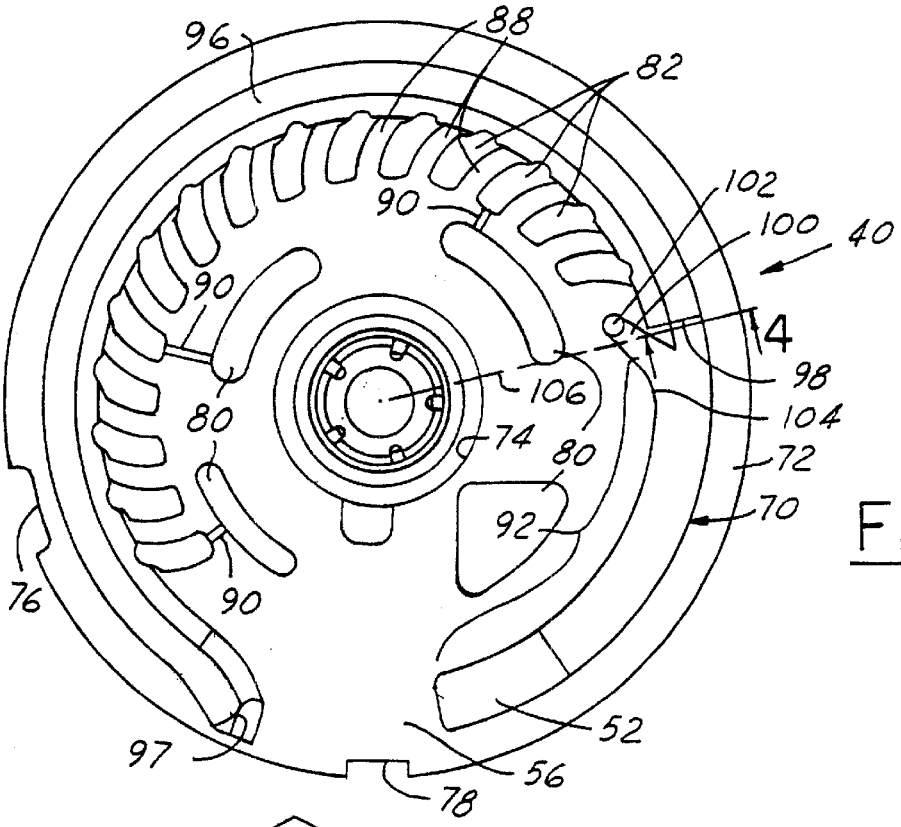
FIG. 3 is a plan view of a lower end cap of the fuel pump assembly.

As best shown in FIG. 3, the first pump plate 40 has an arcuate groove 70 formed in its upper face 72 which defines in part the fuel pumping channel 50. The fuel pump inlet 52 extends through the first pump plate 40 to admit fuel into the groove 70 and fuel pumping channel 50. A central recess 74 provides clearance for the end of the motor shaft 28 and notches 76, 78 about the periphery of the first pump plate 40 facilitate locating it within the housing 12, holding it against rotation and circumferentially aligning it with the ring 48 and the other plate 42. A plurality of circumferentially spaced cavities 80 are located radially inwardly from the groove 70 and may receive fuel which leaks between the first pump plate 40 and impeller 36 to reduce friction between the impeller 36 and the first pump plate 40. The fuel within the different cavities 80 will be at different pressures and may also serve to provide a force acting on the impeller 36 tending to balance circumferentially the forces generally axially the impeller 36 for smoother operation thereof.

Additionally, the first pump plate 40 and pump plate 42 may have corresponding circumferential arrays of generally radially extending pockets 82 formed in their opposed faces 84, 86, (FIG. 2) respectively, which open into the groove 70 at their radially outer edge. The channel pockets 82 define channel vanes 88, extend radially inwardly of the impeller vanes 60, and have been found to provide enhanced pump performance, particularly under hot fuel conditions and low pump speed conditions. Although the reasons for the improved performance provided by the channel pockets 82 and vanes 88 defined thereby are not fully understood, it is believed that the channel vanes 88 create turbulence and reduce the velocity of the fuel as the fuel is pumped through the arcuate pumping channel 50, enhancing vortex action and/or regenerative pumping action on the fuel, especially at low voltage and pump speed conditions which frequently occur in cold weather in the winter. The channel pockets 82 and the channel vanes 88 between the channel pockets 82 preferably are angulated radially in a direction opposed to rotation of the impeller 36. In the preferred embodiment of the invention, the channel pockets 82 and vanes 88 are of arcuate geometry, and have a depth in the axial direction that increases radially inwardly of the impeller periphery. To provide a controlled bleed of fuel from these pockets 82 to the adjacent cavities 80, a small interconnecting groove 90 is provided between them at a desired location in an attempt to control and increase the average pressure within the cavities 80 for improved balancing of the impeller 36 and reduced friction with the pump plates 40 and 42. In general, the upper pump plate 42 may be configured as disclosed in U.S. Pat. No. 5,257,916.

Figure 6:
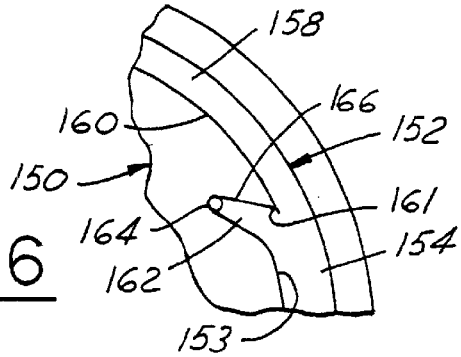
FIG. 6 is a plan view of an end cap of a fuel pump assembly according to another alternate embodiment of the invention.

The groove 70 has a first section 92 extending from the inlet port 52 a predetermined distance towards the outlet port 54 and defining in part an inlet or low pressure portion of the fuel pumping channel 50. The groove 70 also has a second section 96 extending from the first section 92 to an end 97 of the channel generally aligned with the outlet port 54 and defining in part a high pressure portion of the fuel pumping channel 50. The second section 96 preferably has a constant cross-sectional area. The first section 92 preferably has a larger cross-sectional area than the second section 96. The cross-sectional area of the first section 92 preferably changes along its length and decreases toward the second section 96 to provide a transition region 98 between the first section 92 and second section 96. Preferably, the axial depth of the groove 70 is varied to change the cross-sectional area of the first section 92, although it is possible to also change the radial width of the fuel pumping channel 50 as shown in FIG. 6. In any event, in its first section 92, the groove 70 preferably becomes gradually axially shallower as it approaches the second section 96.

Notably, fuel drawn into the groove 70, and fuel pumping channel 50 defined in part by the groove 70, enters the inlet port 52 at a slightly subatmospheric pressure and exits the outlet port 54 at a pressure of generally about 40 psi or higher depending on the particular application with the pressure of fuel substantially continually increasing between the inlet port 52 and outlet port 54. In the relatively large volume and low-pressure environment within the first section 92 of the groove 70, fuel vapor tends to form or expand. Undesirably, this reduces the volume in the groove 70 and fuel-pumping channel 50 available for liquid fuel. Accordingly, it is desirable to remove the fuel vapor from the fuel pumping channel 50 to increase the volume of liquid fuel which may be pumped and the efficiency of the fuel pump 10. Furthermore, it is highly desirable to discharge only liquid fuel from the outlet of the pump to be delivered to the operating engine.

As the fuel moves about the arcuate fuel pumping channel 50, the heavier liquid fuel tends to move radially outwardly in the groove 70 and channel 50 with the lighter fuel vapor disposed at the radial inner portion of the groove 70 and pumping channel 50. According to the invention, to remove the fuel vapor from the fuel pumping channel 50, the first pump plate 40 has a connecting passage or slot 100 open to the first section 92 of the groove 70 and communicating the fuel pumping channel 50 with a vapor vent passage 102 extending through the first pump plate 40, as best shown in FIG. 2. The connecting slot 100 preferably opens into the first section 92 generally in the area of the transition region 98 or immediately upstream of the second section 96 of the groove 70. Preferably, to reduce interference or turbulence caused by flow in the connecting slot 100 from the groove 70, the connecting slot 100 is disposed at an acute included angle relative to the groove 70 with the vapor vent passage 102 disposed downstream of the juncture 104 between the connecting slot 100 and groove 70 with respect to the flow of fuel through the groove 70 and fuel pumping channel 50. Also preferably, the connecting slot 100 is widest at its juncture 104 with the groove 70 and narrows towards the vapor vent passage 102 to improve fluid flow to the vapor vent passage 102. Due to the angle of the connecting slot 100, the vapor vent passage 102 may be disposed downstream of a radius 106 extending to the beginning of the second section 96 of the groove 70. The connecting slot is preferably angularly spaced by about 60° to 120° from the stripper region 56 immediately upstream of the inlet port 52.

Figure 5:
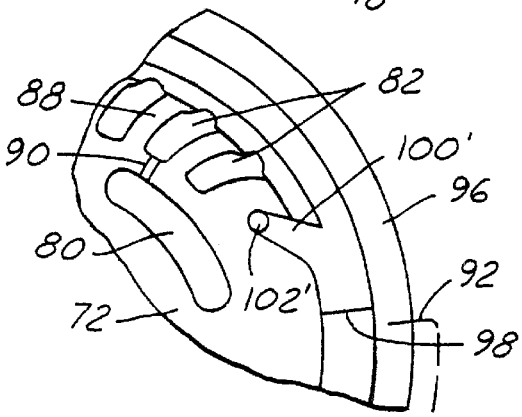
FIG. 5 is a fragmentary plan view of an end cap of a modified fuel pump assembly according to an alternate embodiment of the invention.
Figure 4:
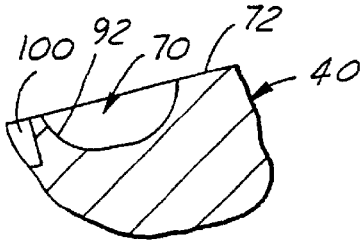
FIG. 4 is a fragmentary sectional view taken generally along line 4—4 of FIG. 3.

Alternatively, as shown in FIG. 5, a connecting slot 100' may open directly into the second section 96 of the groove 70 downstream of the first section 92 and the transition 98 between the sections. Desirably, in this embodiment, the connecting slot 100' opens into the second section 96 immediately downstream of and as close as possible to the first section 92 of the groove 70. The connecting slot 100' is preferably disposed at an acute included angle relative to the groove 70 with the vapor vent passage 102' at a downstream end thereof.

Preferably, the juncture of the slot 100, 100' with the groove 70 is at the radially inner side or edge of the groove or pumping channel and the vapor vent passage 102, 102' is located radially inward of the adjacent portion of the groove and pumping channel. The vapor vent passage 102 communicates with the exterior of the fuel pump 10 which is at a lower pressure than the fuel pumping channel 50 in the area of the connecting slot 100. Thus, fuel vapor tends to move toward the lower pressure and is drawn into the connecting slot 100 and out of the vapor vent passage 102.

The venting of fuel vapor from the fuel-pumping channel 50 reduces the volume of fluid therein. To reduce or negate the effects such reduced volume of fluid may have on the pressure of fluid within the pumping channel 50, the second section 96 has a smaller cross-sectional area than the first section 92. This accommodates the change in volume of fluid in the fuel pumping channel 50 due to the venting of fuel vapor and air therefrom and facilitates maintaining and increasing the pressure of fuel throughout the remainder of the fuel pumping channel 50 to the outlet port 54.

As shown in FIG. 6, a modified pump plate 150 has a groove 152 defining in part the fuel pumping channel 50 with a first section 154 extending from inlet 52 to a second section 158 leading to end 97. The first section 154 is wider than the second section 158 to provide a change in cross sectional area between the sections 154 and 158 without requiring the depth of the groove 152 to change from the first section 154 to the second section 158. If desired, both the width and the depth can be varied in the first section 154. Preferably, to provide the different widths, an inner edge 153 of the first section 154 is formed at a radial distance which is shorter than a radial distance along which an inner edge 160 of the second section 158 is formed providing a step or transition 161 along the radially inner edge of the groove 152. A connecting slot 162 leading to a vapor vent passage 164 is formed in the area of the transition 161. A downstream wall 166 of the connecting slot 162 is defined in part by the transition 161 to provide a vapor diverter extending partially radially into the groove relative to its first section 154. Desirably, vapor which is not immediately drawn into the connecting slot 162 due to the lower pressure in the vent passage 164, as described previously, is directed by the diverter into the connecting slot 162. This improves the venting of vapor from the liquid fuel in the fuel-pumping channel 50. Preferably, the downstream wall 166 and diverter are angled or inclined relative to the groove in a direction generally against the directing of fluid flow in the fuel pumping channel to further improve the directing of vapor into the connecting slot 162.

Desirably, the fuel pump 10 has significantly improved performance at low operating speeds and when pumping hot fuel due to the improved venting of fuel vapor in use. Both of these adverse operating conditions are commonly encountered in automotive vehicle fuel systems. This facilitates use of the fuel pump with an electronic speed control without loss of performance.

What is claimed is:

1. An electric motor fuel pump, comprising:

a housing;

an impeller having an array of a plurality of circumferentially spaced apart vanes rotatably carried in the housing, driven by the electric motor and having opposed sides and a periphery;

a fuel pumping channel having an inlet into which fuel is drawn and an outlet through which fuel is discharged under pressure, the vanes of the impeller being at least in part disposed in the pumping channel;

a first pump plate carried by the housing adjacent to one side of the impeller;

a second pump plate having a face disposed adjacent to the opposite side of the impeller as the first pump plate, a groove formed in the face and defining in part the fuel pumping channel, the fuel pumping channel having a low pressure section extending from the inlet and a high pressure section extending from the low pressure section to the outlet, the low pressure section having a cross-sectional area larger than the cross-sectional area of the high pressure section, a vapor vent passage through the second pump plate having an inlet spaced radially inward from the groove and the fuel pumping channel and located immediately adjacent the transition of the low pressure section into the high pressure section, the vapor vent passage communicating with the exterior of the housing, and a connecting slot in the face communicating the groove with the inlet of the vapor vent passage to permit fuel vapor in the fuel pumping channel to escape therefrom through the vapor vent passage, the connecting slot opening directly into the groove and pumping channel immediately adjacent the transition of the low pressure section into the high pressure section and extending from the groove to the inlet of the vapor vent passage at an acute included angle to the groove and downstream relative to fuel flow through the groove and the pumping channel.

2. The fuel pump of claim 1 wherein the connecting slot communicates with the low pressure section of the fuel pumping channel.

3. The fuel pump of claim 2 wherein the connecting slot opens into the low-pressure section immediately upstream of the high-pressure section.

4. The fuel pump of claim 3 wherein the connecting slot is widest at its juncture with the groove and narrows toward the inlet of the vapor vent passage.

5. The fuel pump of claim 2 wherein the fuel-pumping channel is arcuate and spans between 300 and 350 degrees and the low-pressure section extends from the inlet and spans between 60 to 180 degrees.

6. The fuel pump of claim 1 wherein a first section of the groove which defines in part the low pressure section is axially deeper than a second section of the groove which defines in part the high pressure section with a transition region between the first section and second section and the connecting slot opens into the groove in the area of the transition region.

7. The fuel pump of claim 1 wherein a first section of the groove which defines in part the low pressure section is wider than a second section of the groove which defines in part the high pressure section.

8. The fuel pump of claim 7 which also comprises transition defined between the first section of the groove and the second section of the groove, with the transition defining a diverter constructed to direct vapor toward the vapor vent passage.

9. The fuel pump of claim 8 wherein the diverter extends partially radially into the groove relative to the first section of the groove.

10. The fuel pump of claim 8 wherein the diverter is inclined against the direction of fluid flow in the fuel-pumping channel.

11. The fuel pump of claim 8 wherein a radially inner edge of the first section of the groove extends along an arc at a radial distance which is shorter than the radial distance at which an arcuate radially inner edge of the second section of the groove extends providing the transition between the inner edges of the first section and second section.

12. The fuel pump of claim 1 wherein the connecting slot opens into the high pressure section of the fuel pumping channel.

13. The fuel pump of claim 1 wherein the low pressure section of the fuel pumping channel joins the high pressure section of the fuel pumping channel at least 90° downstream of the inlet of the pumping channel.

14. The fuel pump of claim 12 wherein the connecting slot opens into the high pressure section immediately downstream of the low pressure section.

15. The fuel pump of claim 14 wherein the connecting slot is widest at its juncture with the groove and narrows toward the vapor vent passage.

16. The fuel pump of claim 1 wherein the second pump plate has a stripper region outside of the fuel pumping channel between the inlet and outlet of the fuel pumping channel with the connecting slot angularly spaced from the stripper region by between 600 to 120° degrees.

17. The fuel pump of claim 1 wherein the connecting slot extends at an acute included angle to the groove and generally in the direction of rotation of the impeller.

18. The fuel pump of claim 17 wherein the vapor vent passage is downstream of the juncture between the connecting slot and the groove with respect to the direction of fluid flow in the fuel pumping channel.

19. The fuel pump of claim 18 wherein the vapor vent passage is located radially inward of the adjacent portion of the groove.

20. The fuel pump of claim 1 wherein the connecting slot has an axial depth equal to the axial depth of the groove at the juncture between the connecting slot and the groove.

21. The fuel pump of claim 1 wherein the vapor vent passage is located radially inward of the adjacent portion of the groove.

22. The fuel pump of claim 1 wherein the connecting slot is widest at its juncture with the groove and narrows toward the vapor vent passage.

* * * * *